US006382786B2

(12) United States Patent
Iwanaga et al.

(10) Patent No.: US 6,382,786 B2
(45) **Date of Patent: *May 7, 2002**

(54) LIQUID STORING CONTAINER HAVING IMPROVED INTERNAL STRUCTURE, LIQUID EJECTION HEAD CARTRIDGE USING THE SAME CONTAINER, AND LIQUID EJECTION RECORDING APPARATUS

(75) Inventors: Shuzo Iwanaga, Kawasaki; Eiichiro Shimizu, Yokohama; Kenta Udagawa, Kawasaki, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/536,127

(22) Filed: Mar. 28, 2000

(30) Foreign Application Priority Data

Apr. 15, 1999 (JP) ..... 11-107793

(51) Int. Cl.[7] ..... B41J 2/175
(52) U.S. Cl. ..... 347/86
(58) Field of Search ..... 347/85, 86, 87; 141/7, 18

(56) References Cited

U.S. PATENT DOCUMENTS 5,509,140 A * 4/1996 Koitabashi et al. ..... 347/86
5,682,189 A 10/1997 Takagi ..... 347/87
5,903,294 A 5/1999 Abe et al. ..... 347/87
6,058,984 A * 5/2000 Sato ..... 141/7

FOREIGN PATENT DOCUMENTS

| | | |
|---|---|---|
| EP | 739741 | 10/1996 |
| EP | 791466 | 8/1997 |
| EP | 906830 | 4/1999 |
| JP | 57-16385 | 1/1982 |

* cited by examiner

*Primary Examiner*—Anh T. N. Vo
(74) *Attorney, Agent, or Firm*—Fitzpatrick, Cella, Harper & Scinto

(57) ABSTRACT

A liquid storing container attachable and detachable to and from a recording device includes a negative pressure producing member storage chamber which has a bottom wall and opposed side walls and which accommodates a negative pressure producing member and is equipped with a liquid supplying section in the bottom wall and an atmosphere communication section. A partition wall separates the negative pressure producing member storage chamber from a liquid storage chamber and defines a communicating hole for establishing communication therebetween. A path in the vicinity of the communicating hole on the negative pressure producing member storage chamber side introduces the atmosphere from the negative pressure producing member storage chamber into the liquid storage chamber. The negative pressure producing member is made with a fiber material having directionality and the communication hole is offset from the bottom wall.

16 Claims, 11 Drawing Sheets

LIQUID STORING CONTAINER HAVING IMPROVED INTERNAL STRUCTURE, LIQUID EJECTION HEAD CARTRIDGE USING THE SAME CONTAINER, AND LIQUID EJECTION RECORDING APPARATUS

BACKGROUND OF THE INVENTION

1. Field of the Invention

The present invention relates to a liquid storing container, a liquid ejection head cartridge (which will sometimes be referred to hereinafter as an ink jet head) equipped with the same container and a liquid ejection head (which will sometimes be referred to hereinafter as an ink jet cartridge), and an liquid ejection recording apparatus (which will sometimes be referred to hereinafter as a liquid jet recording apparatus) in which the same cartridge is mounted for recording, and more particularly to a liquid storing container having an internal structure improved for stabilizing a liquid supply property, a liquid ejection head cartridge carrying the same container and a liquid ejection head, and a liquid ejection recording apparatus incorporating the same cartridge for recording.

2. Description of the Related Art

In general, an ink tank (including a type of being integrated with a recording head and a type in which an ink tank is replaceable separately) serving as a liquid storing container for use in the field of liquid jet recording (which will equally be referred to hereinafter as an ink jet recording) has a construction to adjust the holding capability of an ink stored in the ink tank for achieving excellent ink supply to a recording head which ejects a liquid (a liquid to be used for recording; including a type containing a coloring component (s), and a type not containing a coloring component but which acts on a liquid containing a coloring component for upgrading the recording quality, which hereinafter will be referred to simply as an ink). This holding capability is called negative pressure, because it is for making the pressure in an ink ejecting section of a recording head negative with respect to the atmosphere (a member for production of such a negative pressure will equally be referred to hereinafter as a negative pressure producing member).

As one of the easiest ways of producing such a negative pressure, there has been known a means in which an ink absorber made from a porous material such as a urethane foam is provided in an ink tank to utilize a capillary capability the ink absorber.

In addition, there has been proposed an ink tank (which will be referred to hereinafter as a juxtaposed type ink tank) in which, for the purpose of enhancing the volume efficiency of the ink in the interior of the ink tank, a chamber for accommodating the ink absorber and a chamber for storing the liquid directly are juxtaposed so that they are made to partially communicate with each other.

FIG. 10A is a cross-sectional view schematically showing a construction of an ink tank in which, as mentioned above, a chamber for accommodating the ink absorber and a chamber for storing the liquid directly are juxtaposed so that they are made to partially communicate with each other. The interior of the ink tank 10 is partitioned by a partition wall 38, having a communicating hole 40, into two spaces. One space is hermetically sealed except the communicating hole 40 of the partition wall 38 serves a liquid storage chamber 36 for storing an ink directly, while the other acts as a negative pressure producing member storage chamber 34 for accommodating a negative pressure producing member 32.

On a wall surface defining this negative pressure producing member storage chamber 34, there are formed an atmosphere communication section (atmosphere communicating opening) 12 for introducing the atmosphere into a container resulting from ink consumption, and a supply opening 14 having an ink leading member 39 for leading the ink from the tank to a recording head section (not shown). In FIG. 10A, the area in which the negative pressure producing member holds the ink is indicated by an oblique-line section. Additionally, the ink stored in the space is indicated by a mesh section.

In the foregoing construction, on consumption of the ink in the negative pressure producing member 32 by the recording head, air is introduced through the atmosphere communication opening 12 into the negative pressure producing member storage chamber 34 passing into the liquid storage chamber 36 through the communicating hole 40 of the partition wall 38. Instead, the ink is put from the liquid storage chamber 36 through the communicating hole 40 of the partition wall 38 into the negative pressure producing member 32 in the negative pressure producing member storage chamber 34 (this operation will be referred to hereinafter as an air-liquid replacement operation). Accordingly, if the recording head consumes the ink, the ink is drawn into the negative producing member 32 according to the consumption thereof so that the negative pressure producing member 32 retains a constant quantity of ink to maintain the negative pressure to the recording head approximately constant, thus stabilizing the ink supply to the recording head.

In addition, in the example shown in FIG. 10A, in the vicinity of the communicating section between the negative producing member storage chamber 34 and the ink storage chamber 36, an atmosphere introducing groove 51 is provided as a structure to promote the introduction of the atmosphere, while, in the vicinity of the atmosphere communicating section, a space (buffer chamber) 44, not accommodating a negative pressure producing member, is defined by ribs 42.

In the conventional art, in many cases, the urethane foam has commonly been employed as the aforesaid negative pressure producing member (which is equally referred to as an ink absorber) as mentioned above. However, the urethane foam requires further improvement in the service efficiency of ink; besides, not always exhibiting a suitable characteristic depending on the ink property.

For this reason, this applicant has proposed the use of a fiber made from an olefin-based resin having a thermal plasticity, which shows, as an ink absorber, a superior ink property throughout a wide range.

Meanwhile, in a juxtaposed type tank shown in FIG. 10A, the important factors in the stable supply of an ink are the structure of a communicating hole constituting a connecting section between a negative pressure producing member storage chamber and a liquid storage chamber and the structure on the periphery thereof.

That is, in the case of the juxtaposed type ink tank, the bottom line is the stable introduction of air from the atmosphere communicating section (atmosphere communicating opening) 12 through the atmosphere introducing groove 51 of the partition wall 38 into the liquid storage chamber in connection with the ink consumption. If air is introduced through places other than this air introduction route, an unnecessary air-liquid replacement, not related to the ink consumption, takes place, which can cause an excessive supply of to leak toward the exterior of the tank.

In the case of the use of the urethane foam as the negative pressure producing member, since the urethane foam per se has a structure showing a high elasticity, it comes satisfactorily into contact with the communicating hole and an inner wall surface constituting the periphery thereof in a state accommodated in the negative pressure producing member storage chamber, which hardly causes the aforesaid unexpected air-liquid replacement, thus not creating problems on the practical use.

However, a fiber member involving fibers and displaying more preferable characteristics relating to a characteristic to the ink and a service efficiency as compared with the urethane foam does not exhibit a high elasticity because of its property on the material unlike the urethane foam (particularly, although a fiber member whose felt-like fibers do not run remarkably to one direction shows a relatively high elasticity, a fiber member made to have directionality can depend upon the direction the fibers extend in). Accordingly, sometimes, it does not reach an excellent contacting condition with an inner wall surface of an tank in a state accommodated in the negative pressure producing member storage chamber. Although the prevention from such an event relies upon high-accuracy cutoff, difficulty can be encountered in achieving a desirable cutoff accuracy.

Especially, in the case of the juxtaposed type ink tank in which, as shown in FIG. 10A, the ink supply is made from a lower section of the ink tank and the ink tank and the head are placed in a separated condition, in order to secure the close contact of the ink leading member 39 located in the ink supplying section with a filter placed at the tip portion of a supply pipe set in the head, there is a need to push up the aforesaid ink leading member 39 by the supply pipe when the ink tank is set on a mounting holder attached onto the head. At this time, the bottom surface of the absorber is simultaneously lifted by the influence of the pushed up ink leading member 39.

In the case of the urethane foam, the material itself has a high elasticity so that its local deformation absorbs the pushed-up ink leading member 39; accordingly, variation does not occur in the locating construction of the urethane foam near the communicating hole.

However, the fiber absorber occasionally displays poor elasticity due to the fiber directionality constituting the characteristic of the material; whereupon, the fiber absorber is also pushed up by the pushed-up ink leading member 39 so that variation occurs in the locating construction of the fiber absorber between the ink supplying section and the vicinity of the communicating hole, which tends to establish a passage between the bottom surface of the fiber absorber storage chamber and the bottom surface of the fiber absorber.

In such a juxtaposed type ink tank, the liquid storage chamber except the communicating hole must be sealed hermetically. In addition, for accomplishing stable air-liquid replacement, it is preferable that the communicating hole is covered with the negative pressure producing member.

Nevertheless, in the case of a conventional ink tank of a juxtaposed type juxtaposing a negative pressure producing member storage chamber and a liquid storage chamber as shown in FIG. 10B or 10C, since the communicating hole for making a connection between the negative pressure producing member storage chamber and the liquid storage chamber is defined by an inner wall organizing the tank bottom surface or the tank side surface, in the case in which the negative pressure such as the aforesaid fiber absorber is accommodated therein, the close adhesion between the fiber absorber and the ink tank case inner wall becomes insufficient due to the aforesaid cause such as the tank connection so that a gap (which will equally be referred to hereinafter as a path, an air path or a ridge line path) develops between the fiber absorber and the ink tank case inner wall; hence, this gap communicates with the communicating hole and further communicates with the external atmosphere, which can incur an unnecessary and expected air-liquid replacement to give rise to an external leak of ink.

FIG. 10D shows one example of an ink tank in which the unnecessary air-liquid replacement has occurred. An air path 60 defines an ink path when once communicating with the liquid storage chamber, thus producing the ink passage toward the supplying section.

FIG. 10E illustrates a section of the ink tank, indicated by oblique lines, where the air path 60 tending to produce the unnecessary air-liquid replacement develops easily. As illustrated, a gap (ridge line path) tends to develop in a ridge line of a joint between the wall surfaces.

As described above, if a fiber absorber having a directionality is employed as the negative pressure producing member, the failure of the close adhesion to the tank inner wall surface or the ridge line tends to occur, and if forcible insertion takes place, buckling will occur in the fiber absorber to incur unexpected ink surplus or to provide, for example, unsatisfactory ink supply ability or insufficient negative pressure.

As described above, if an air path develops to cause ink leakage from an ink supply opening, desirable printing becomes difficult, the ink drops onto a print medium or the printer body is contaminated with the ink, and even there is a possibility of, for example, soiling hands or clothes of the user at the ink tank replacement.

SUMMARY OF THE INVENTION

Accordingly, it is an object of the present invention to provide a liquid storing container which is of a juxtaposed type capable of, even if a fiber member having directionality and used as an absorber moves in the interior of a tank at the mounting of the tank, preventing the communication of an air path with an ink chamber so as not to create the aforesaid problems of ink leakage, deterioration of the print quality and others, and further to provide a liquid ejection head cartridge in which the same container and a liquid ejection head are integrated with each other and a liquid ejection recording apparatus in which the same cartridge is mounted for recording.

For achieving this object, in accordance with this invention, there is provided a liquid storing container attachable and detachable to and from recording means, comprising a negative pressure producing member storage chamber made to accommodate a negative pressure producing member and equipped with a liquid supplying section and an atmosphere communicating section, a liquid storage chamber having a communicating hole for establishing a communication with the negative pressure producing member storage chamber and made to define a substantially hermetically sealed space for storing a liquid to be supplied to the negative pressure producing member, a partition wall for establishing a partition between the negative pressure producing member storage chamber and the liquid storage chamber and for defining the communicating hole, and a path made in the vicinity of the communicating hole on the negative pressure producing member storage chamber side for introducing the atmosphere from the negative pressure producing member storage chamber into the liquid storage chamber, wherein the negative pressure producing member is made with a fiber material having directionality and the communicating hole is in a non-contacting condition with a ridge line defined by crossing of the partition wall and an inner wall constituting the negative pressure producing member storage chamber.

With this construction, even if an air path develops between the negative pressure producing member and an inner wall constituting the negative pressure producing member storage chamber or a ridge line portion, it is possible to prevent the air path from communicating through the communicating hole with the liquid storage chamber.

Accordingly, it is possible to prevent unnecessary air-liquid replacement for preventing unnecessary ink leakage from the liquid storing container, and to reduce the necessity to improve the accuracy for avoiding the occurrence of an air path, that is, to improve the margin for facilitating the manufacturing of the liquid storing container. In addition, even if a situation such as drop of the liquid storing container arises, since the possibility of the communication of the air path with the communicating hole is reducible, thus providing a liquid storing container, a liquid ejection head cartridge and a liquid ejection recording apparatus which are capable of improving their reliability.

BRIEF DESCRIPTION OF THE DRAWINGS

FIG. 1A is a perspective view of the first embodiment and FIGS. 1B and 1C are cross-sectional views thereof;

FIG. 2A is a perspective view of the second embodiment and FIG. 2B is a cross-sectional view thereof;

FIG. 3A is a perspective view of the modification and FIG. 3B is a cross-sectional view thereof;

FIG. 4A is a perspective view of the third embodiment and FIG. 4B is a cross-sectional view thereof;

FIG. 5A is a perspective view of the fourth embodiment and FIG. 5B is a cross-sectional view thereof;

FIG. 6A is a perspective view of the second embodiment and FIG. 6B is a cross-sectional view thereof;

FIG. 7A is a perspective view of the sixth embodiment and FIG. 2B is a cross-sectional view thereof;

FIG. 8A is a perspective view of the seventh embodiment and FIG. 8B is a cross-sectional view thereof;

FIG. 9A is a perspective view of the eighth embodiment and FIG. 9B is a cross-sectional view thereof;

DESCRIPTION OF THE PREFERRED EMBODIMENTS

A detailed description will be given hereinbelow of embodiments of the present invention with reference to the drawings.

Although in the following description of the embodiments an ink is taken as a liquid to be used in a liquid supplying method and a liquid supplying system according to this invention, the liquid which can be put to use is not limited to the ink but also including, for example, a treating liquid for a recording medium in the ink jet recording field.

In addition, in the cross-sectional views, the area in which a negative pressure producing member holds an ink is indicated by an oblique-like section while an ink accommodated in a space is indicated by a mesh section. However, for the purpose of making clear the configurations on the periphery of a communication hole and a cross-sectional configuration thereof, the negative pressure producing member or the ink will sometimes be omitted depending on the illustrations.

Concrete means for achieving the foregoing object will become apparent from the following construction.

(First Embodiment)

Figure 1A:
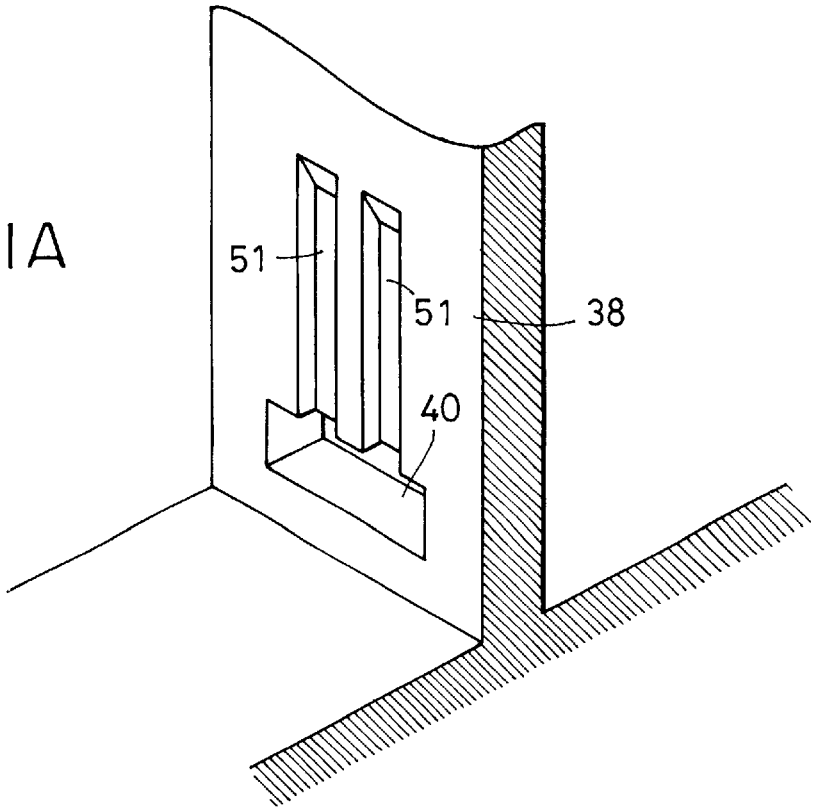
FIGS. 1A to 1C are schematic illustrations useful for describing a first embodiment of the present invention; of these illustrations.
Figure 1B:
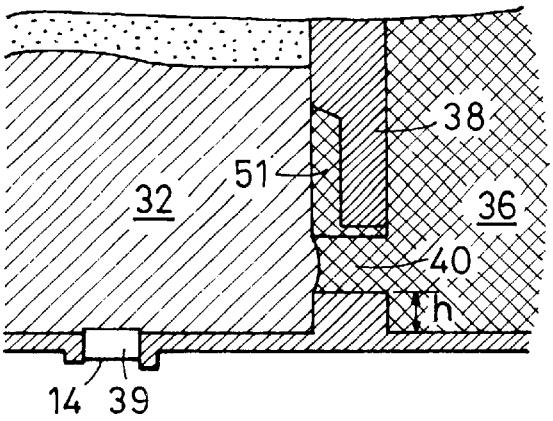
Figure 1C:
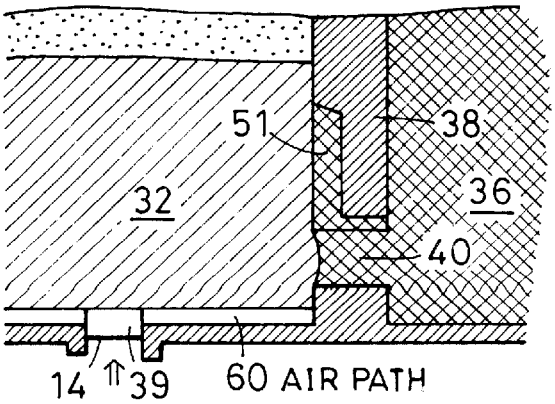

FIGS. 1A to 1C are partially enlarged illustrations of a section of a liquid storing container according to a first embodiment of this invention, lying in the vicinity of its communicating hole. FIG. 1A is a perspective view schematically showing the liquid storing container section, viewed from a negative pressure producing member storage chamber side, and FIGS. 1B and 1C are side cross-sectional views schematically showing the liquid storing container section.

In FIG. 1A, under a partition wall 38 on a negative pressure producing member storage chamber side, a fiber absorber is accommodated, while an atmosphere introducing path 51 is formed to come into contact with the fiber absorber, and a communicating hole 40 is made to communicate with the atmosphere introducing path 51. As FIG. 1B shows, the communicating hole 40 establishes a communication between a negative pressure producing member storage chamber accommodating a fiber absorber 32 and a liquid storage chamber 36. In this embodiment, in the interior of the negative pressure producing member storage chamber, a fiber absorber is accommodated which is made with two kinds of fiber materials to have a coaxial configuration in its cross section. The material of the central section of the fiber absorber is made of polypropylene while the material of the circumferential section thereof is made of polyethylene. This invention is not limited to this, but it is also appropriate to use a fiber absorber made from an olefin-based fiber. In this embodiment, the fiber of the fiber absorber is directionally parallel with the bottom surface of the ink tank.

Although the communicating hole 40 is situated in the vicinity of a lower end portion of the partition wall 38, as illustrated, the outer circumferential section of the communicating hole 40 is not brought into contact with any of the tank case inner walls intersecting the partition wall 38 in the interior of the negative pressure producing member storage chamber.

A state of the aforesaid liquid storing container will be described hereinbelow with reference to FIG. 1C. Even if the adhesion between the fiber absorber and the tank inner wall is poor or the adhesion between the fiber absorber and the tank inner wall is broken by the push-up of a ink leading member 39 to produce a partial air path 60, the air path 60 is blocked by the partition wall 38 standing on a lower end side of a partitioning wall so that it does not communicate with the liquid storage chamber 36 to maintain the substantially hermetically sealed condition of the liquid storage chamber; therefore, the unnecessary and unexpected air-liquid replacement does not occur. Whereupon, the air-liquid replacement takes place stably through the atmosphere introducing path, thereby preventing unexpected ink leakage from the ink tank.

In this embodiment, the distance h between the communicating hole 40 and the a lower end surface (bottom surface) of an inner wall of the negative pressure producing member storage chamber is set at approximately 1 mm in consideration of the ink remainder in the liquid storage chamber 36, the stability of the air-liquid replacement operation and others. This distance h is required to be determined properly on the basis of the kind of the negative pressure producing member, the degree of the push-up of an ink leading member, the tank case dimension and others, and is selectable properly in a range of approximately 0.2 mm to 1.0 mm. Incidentally, even if the distance h is approximately 1 mm, because of sometimes moving to the negative pressure producing member storage chamber side due to the vibrations of the ink generated by the scanning of the ink tank, the ink consumption efficiency does not drop extremely.

(Second Embodiment)

Figure 2A:
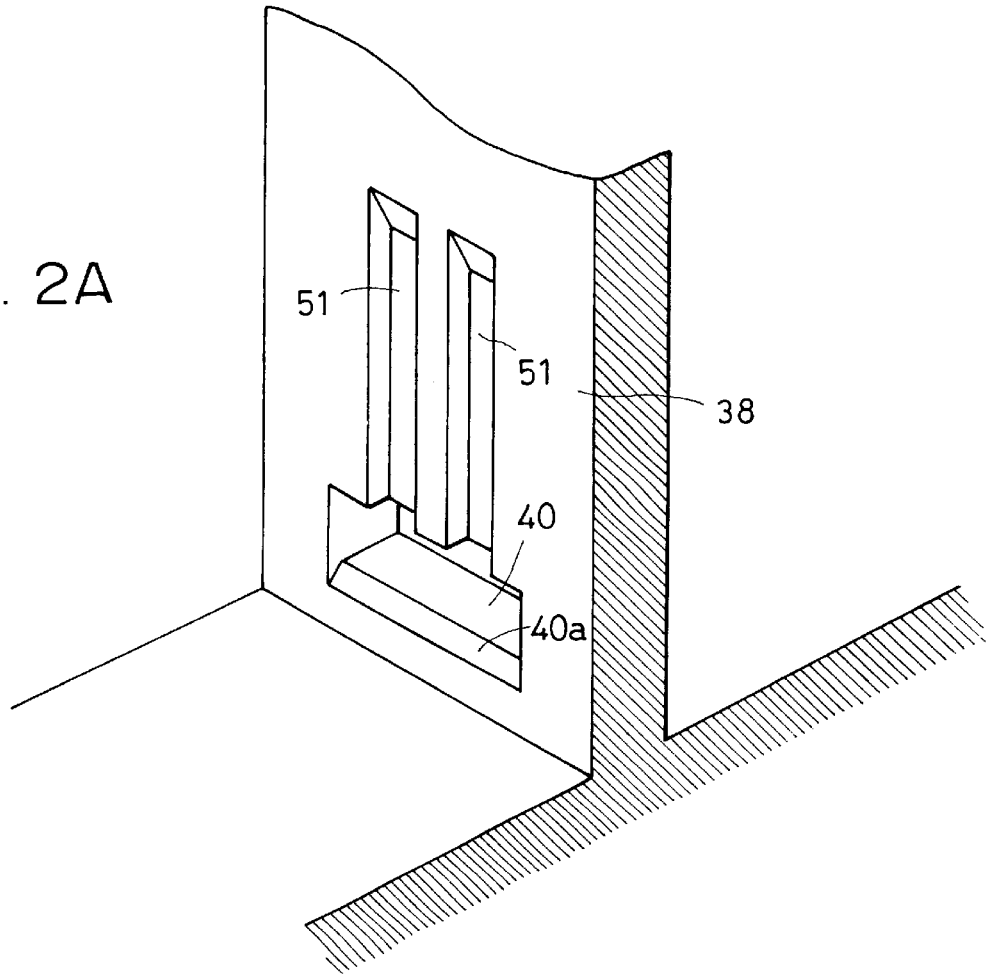
FIGS. 2A and 2B are schematic illustrations useful for describing a second embodiment of this invention; of these illustrations.
Figure 2B:
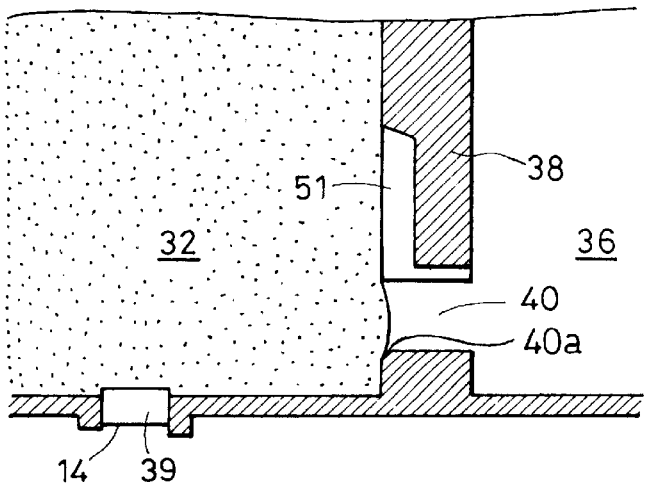

FIGS. 2A and 2B are explanatory illustrations schematically showing a liquid storing container according to a second embodiment of this invention. FIG. 2A is a perspective view of the liquid storing container and FIG. 2B is a cross-sectional view thereof.

The construction of this embodiment is the same as that of the first embodiment except that a lower end side of an outer circumferential section of a communicating hole is formed into a tapered configuration 40*a*. In addition to sufficiently exhibiting the above-mentioned effects, this can restrain a corner portion of a fiber absorber on the bottom surface side from being hooked by a lower end portion of the communicating hole to be torn up even when the fiber absorber is inserted into a negative pressure producing member storage chamber from above a tank container for the construction of a tank. Accordingly, it is possible to prevent unstable ink supplying operation stemming from the tearing-up.

Figure 3A:
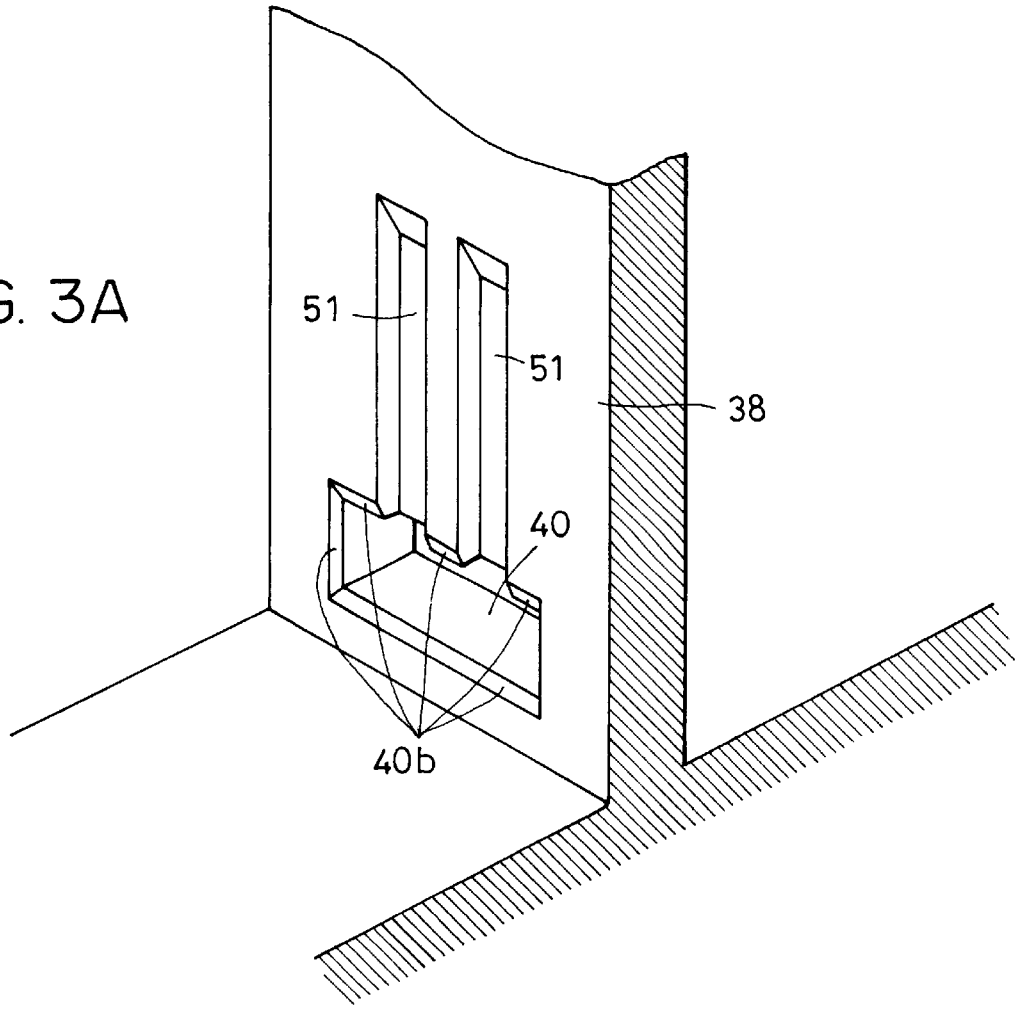
FIGS. 3A and 3B are schematic illustrations useful for describing a modification of the second embodiment of this invention; of these illustrations.
Figure 3B:
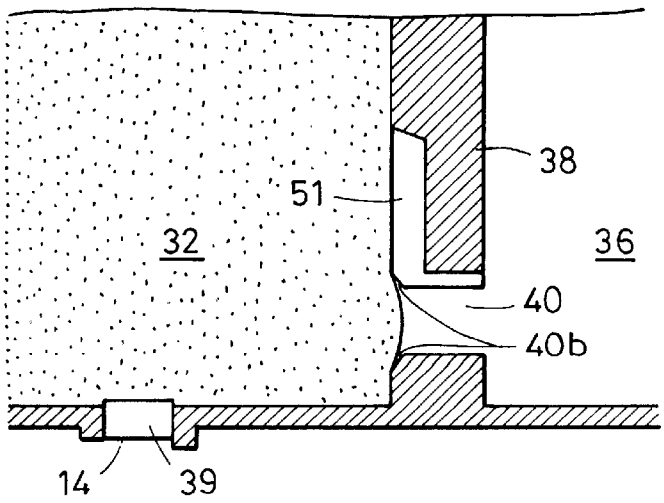

Incidentally, as shown in the perspective of FIG. 3A and in the cross-sectional view of FIG. 3B, it is preferable that the entire surface of the outer circumferential section of a communicating hole is formed to have a tapered configuration 40*b*. This can prevent the tearing-up of the absorber at the insertion irrespective of the direction of insertion of the absorber.

(Third Embodiment)

Figure 4A:
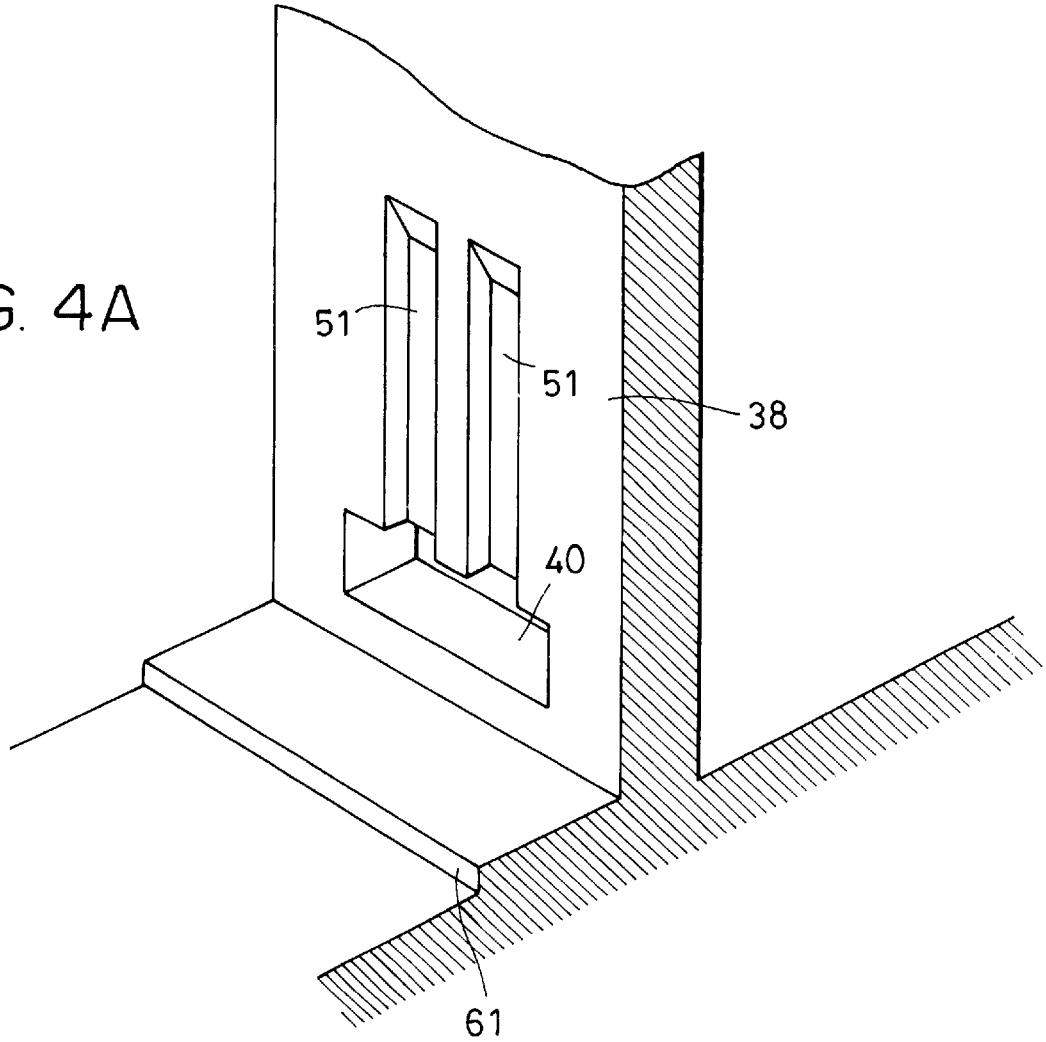
FIGS. 4A and 4B are schematic illustrations useful for describing a third embodiment of this invention; of these illustrations.
Figure 4B:
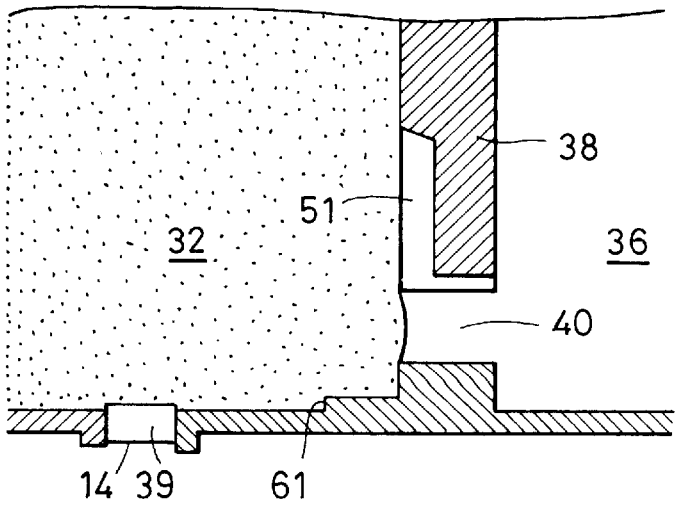

FIGS. 4A and 4B are schematic explanatory illustrations of a portion of a liquid storing container according to a third embodiment of this invention. FIGS. 4A is a perspective view schematically showing the liquid storing container, and FIG. 4B is a cross-sectional view schematically showing thereof.

In comparison with the construction shown in FIGS. 1A to 1C, in this embodiment, a slight step 61 is formed in the vicinity of a partition wall 38 lying at a bottom section of a negative pressure producing member storage chamber.

This step 61 prevent air path which tends to occur at a ridge line portion defined by a bottom surface and side surface of the negative pressure producing member storage chamber.

(Fourth Embodiment)

Figure 5A:
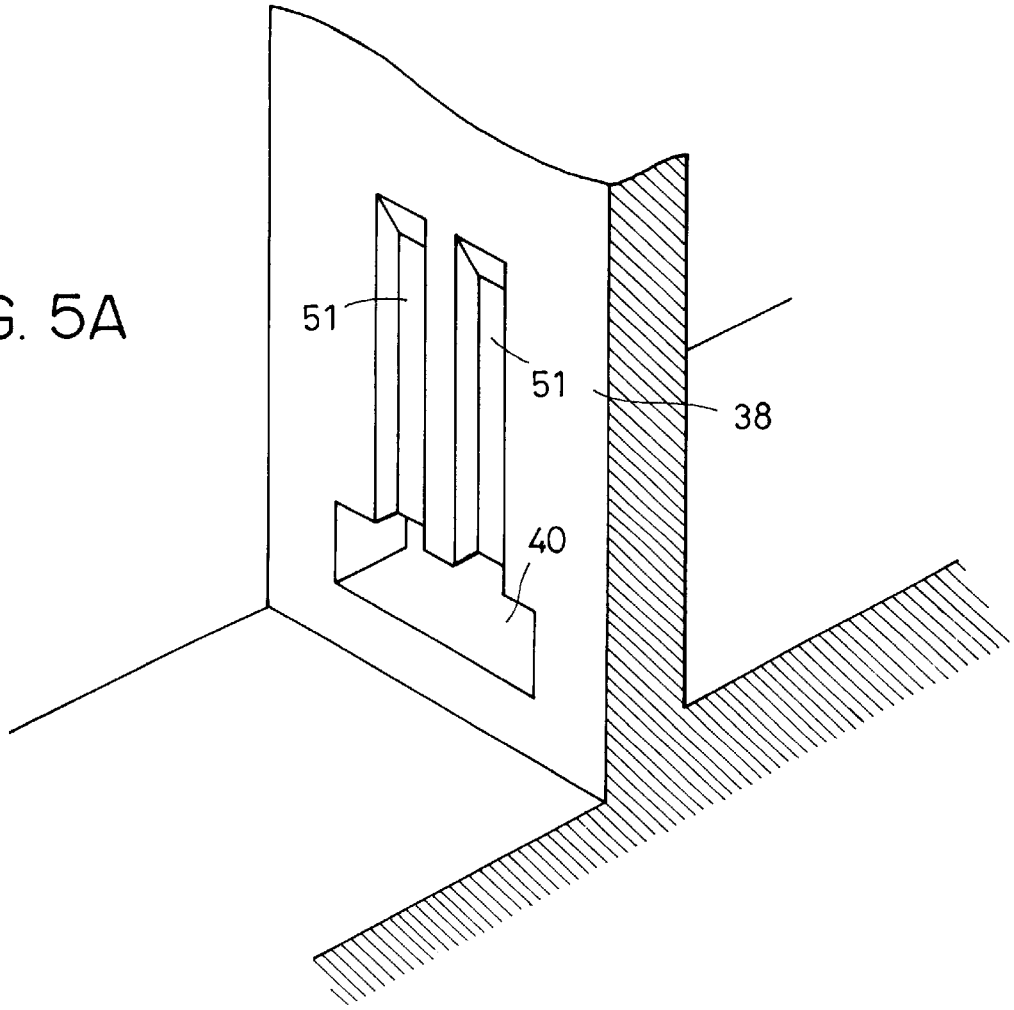
FIGS. 5A and 5B are schematic illustrations useful for describing a fourth embodiment of this invention; of these illustrations.
Figure 5B:
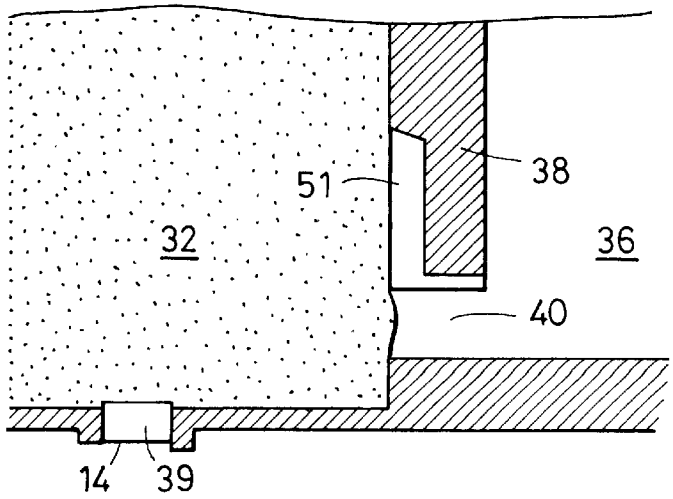

FIGS. 5A and 5B are schematic explanatory illustrations of a portion of a liquid storing container according to a fourth embodiment of this invention. FIG. 5A is a perspective view schematically showing the liquid storing container while FIG. 5B is a cross-sectional view thereof.

In this embodiment, a lower end of a communicating hole 40 and a bottom surface portion of a liquid storage chamber 36 are made to be equal in height to each other. With this construction, ink remaining in the liquid storage chamber 36 is avoidable. In addition, there is no need to lower the step h with respect to a negative pressure producing member storage chamber which is made in consideration of the ink consumption as shown in FIGS. 1A to 1C, and it is possible to freely determine the step in the range of solving the air path problem. Incidentally, if the step is too high, the quantity of ink accommodated by the liquid storage chamber 36 lessens. Accordingly, the step may be determined in consideration of the ink storage quantity.

(Fifth Embodiment)

Figure 6A:
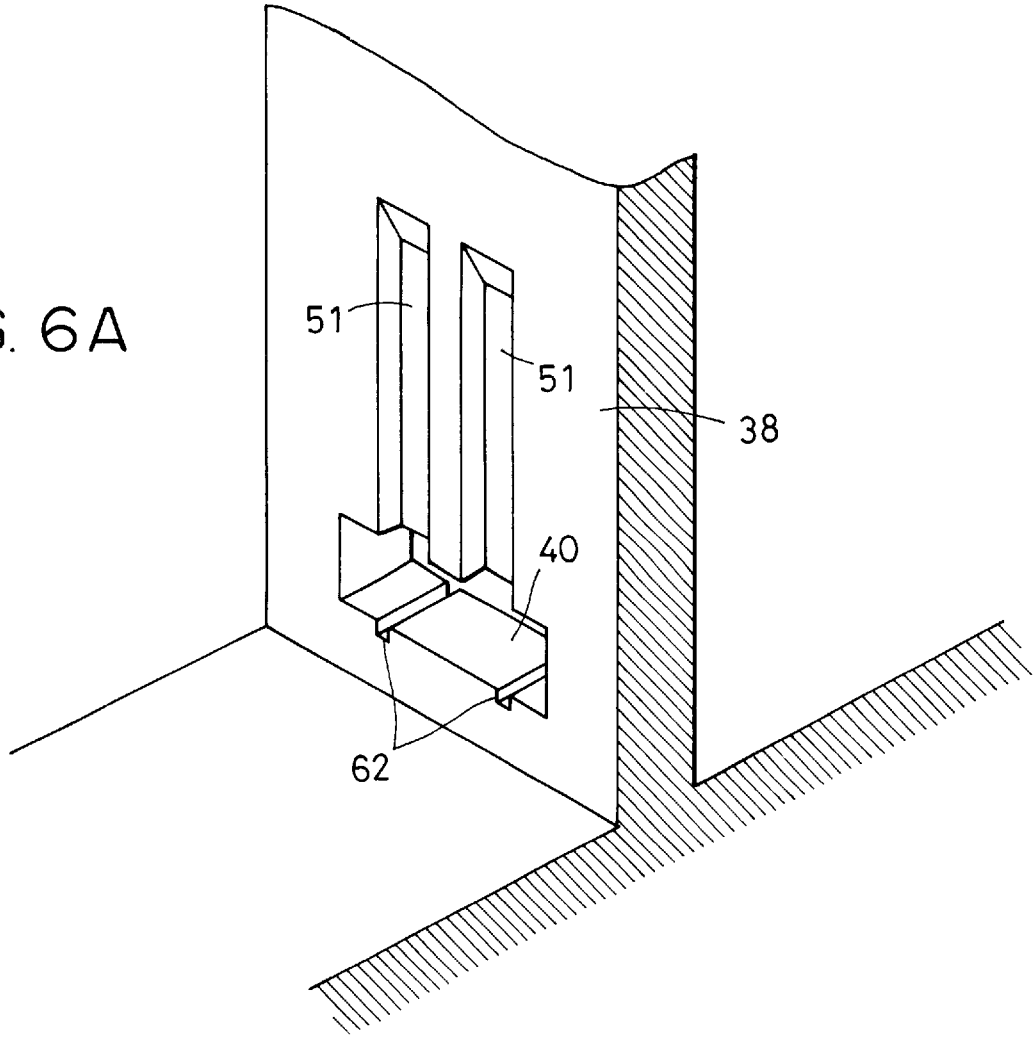
FIGS. 6A and 6B are schematic illustrations useful for describing a fifth embodiment of this invention; of these illustrations.
Figure 6B:
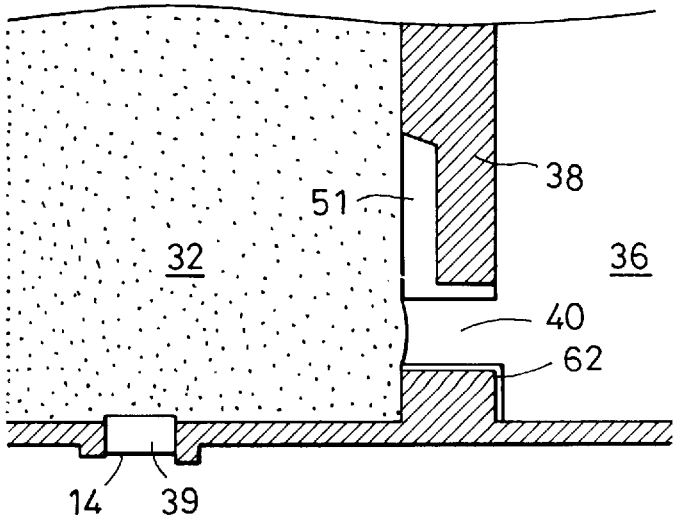

FIGS. 6A and 6B are schematic explanatory illustrations of a portion of a liquid storing container according to a fifth embodiment of this invention. FIG. 6A is a schematic perspective view and FIG. 6B is a schematic cross-sectional view.

In this embodiment, in addition to the construction of the liquid storing container according to the first embodiment, a groove 62 generating capillary action is made in a lower end portion of a communicating hole 40. The capillary action produced by this groove 62 can lead an ink in a liquid storage chamber 36 into a negative pressure producing member storage chamber, thus reducing the ink remaining in the liquid storage chamber 36.

(Sixth Embodiment)

Figure 7A:
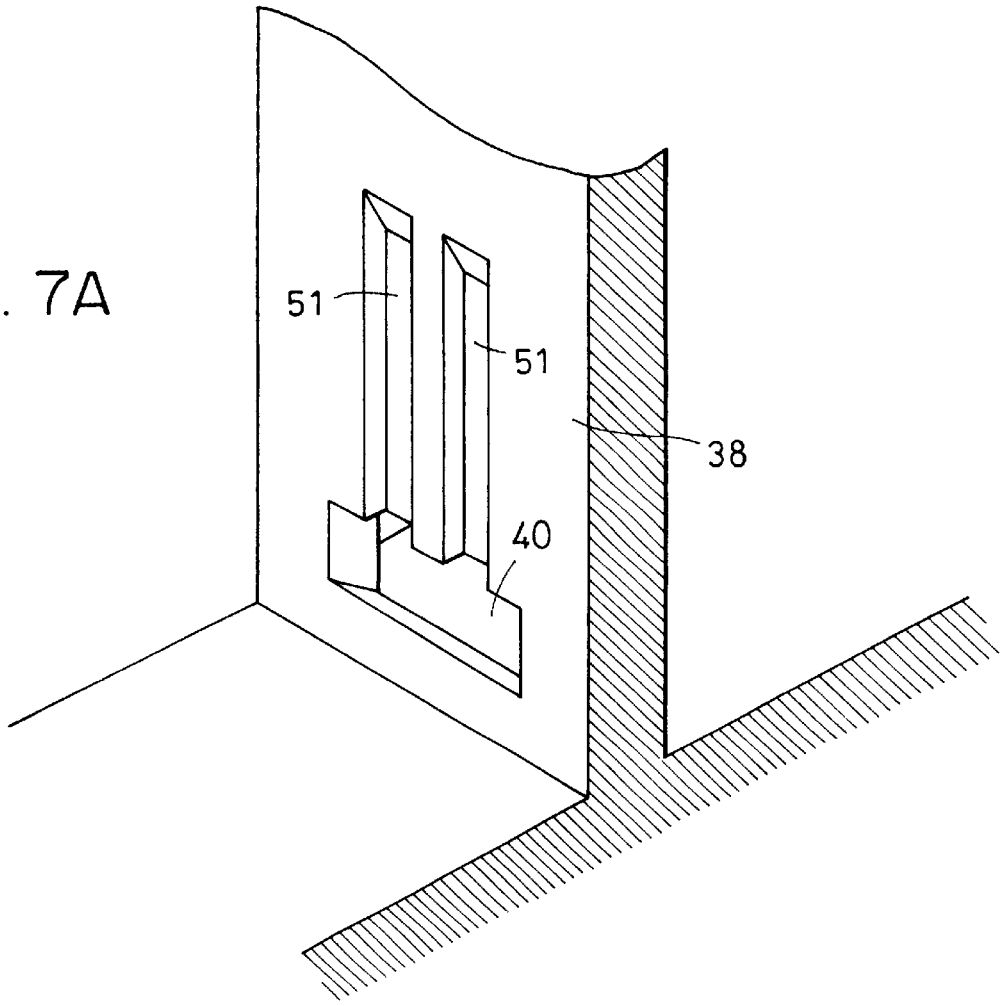
FIGS. 7A and 7B are schematic illustrations useful for describing a sixth embodiment of this invention; of these illustrations.
Figure 7B:
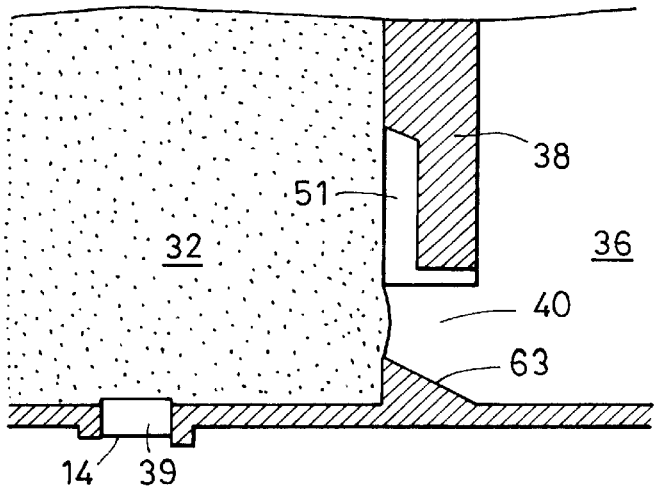

FIGS. 7A and 7B are schematic explanatory illustrations of a portion of a liquid storing container according to a sixth embodiment of this invention. FIG. 7A is a schematic perspective view and FIG. 7B is a schematic cross-sectional view.

In this embodiment, a slope 63 is formed at a step portion on the liquid storage chamber side. The formation of the slope 63 increases the ink storage quantity as compared with the above-described fourth embodiment, and allows the ink to more easily move into a negative pressure producing member storage chamber as compared with the above-described first embodiment, thus reducing the ink which remains in the liquid storage chamber.

(Seventh Embodiment)

Figure 8A:
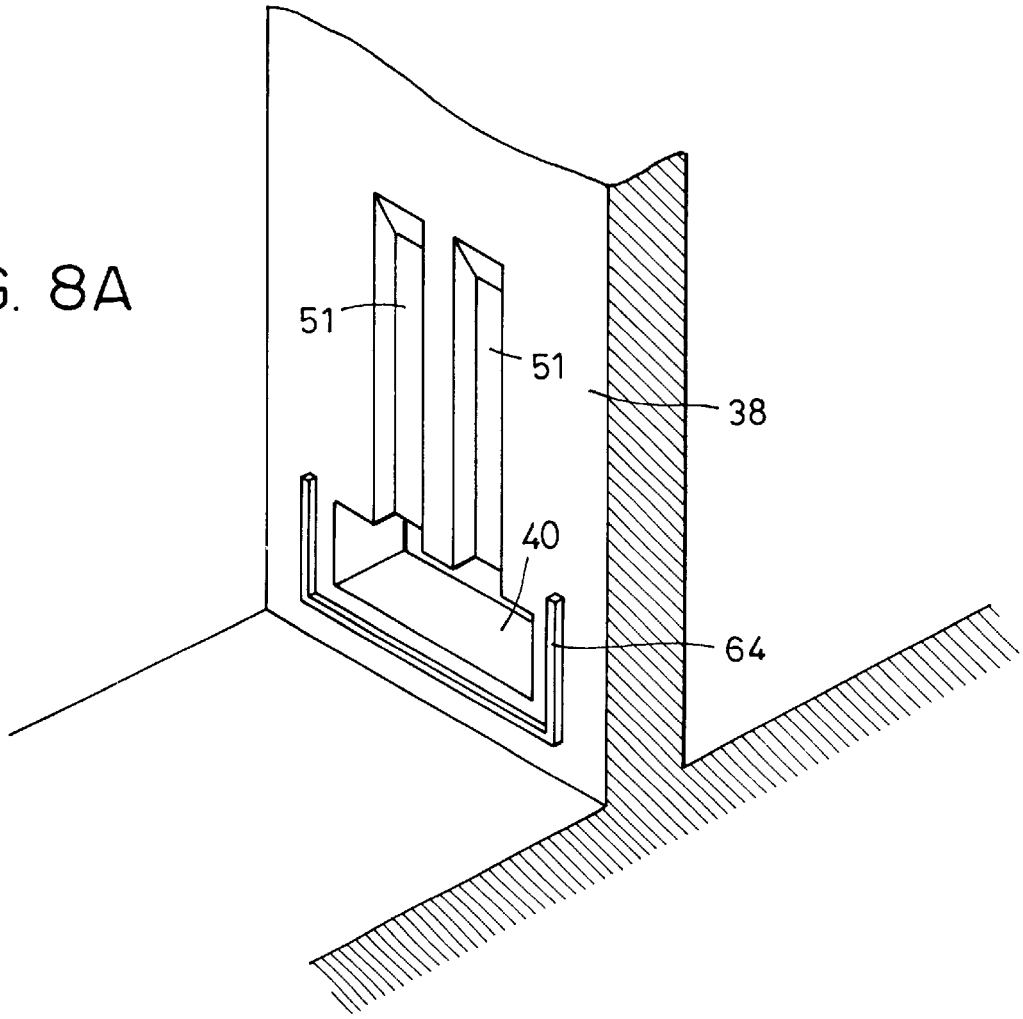
FIGS. 8A and 8B are schematic illustrations useful for describing a seventh embodiment of this invention; of these illustrations.
Figure 8B:
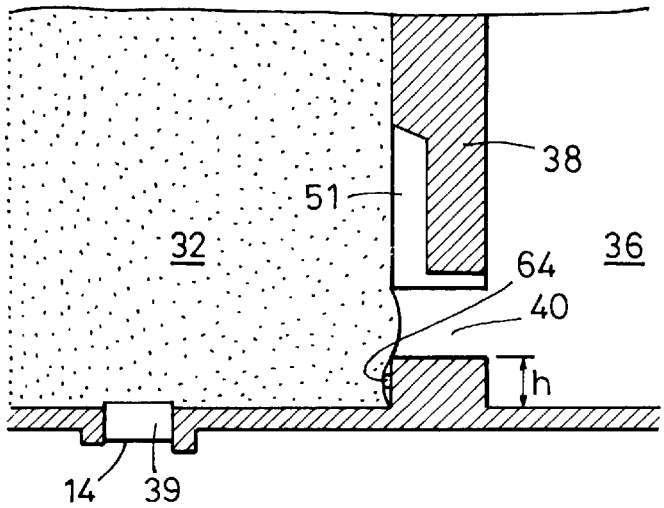

FIGS. 8A and 8B are schematic illustrations of a portion of a liquid storing container according to a seventh embodiment of this invention. FIG. 8A is a schematic perspective view while FIG. 8B is a schematic cross-sectional view.

In this embodiment, a rib 64 is formed in the vicinity of a lower end portion and side edge portions of a communication hole 40 of a liquid storing container corresponding to that according to the first embodiment. The formation of the rib 64 can block an air path created toward the communication hole 40 in directions along these portions, thus further improving the reliability of the ink supply.

(Eighth Embodiment)

Figure 9A:
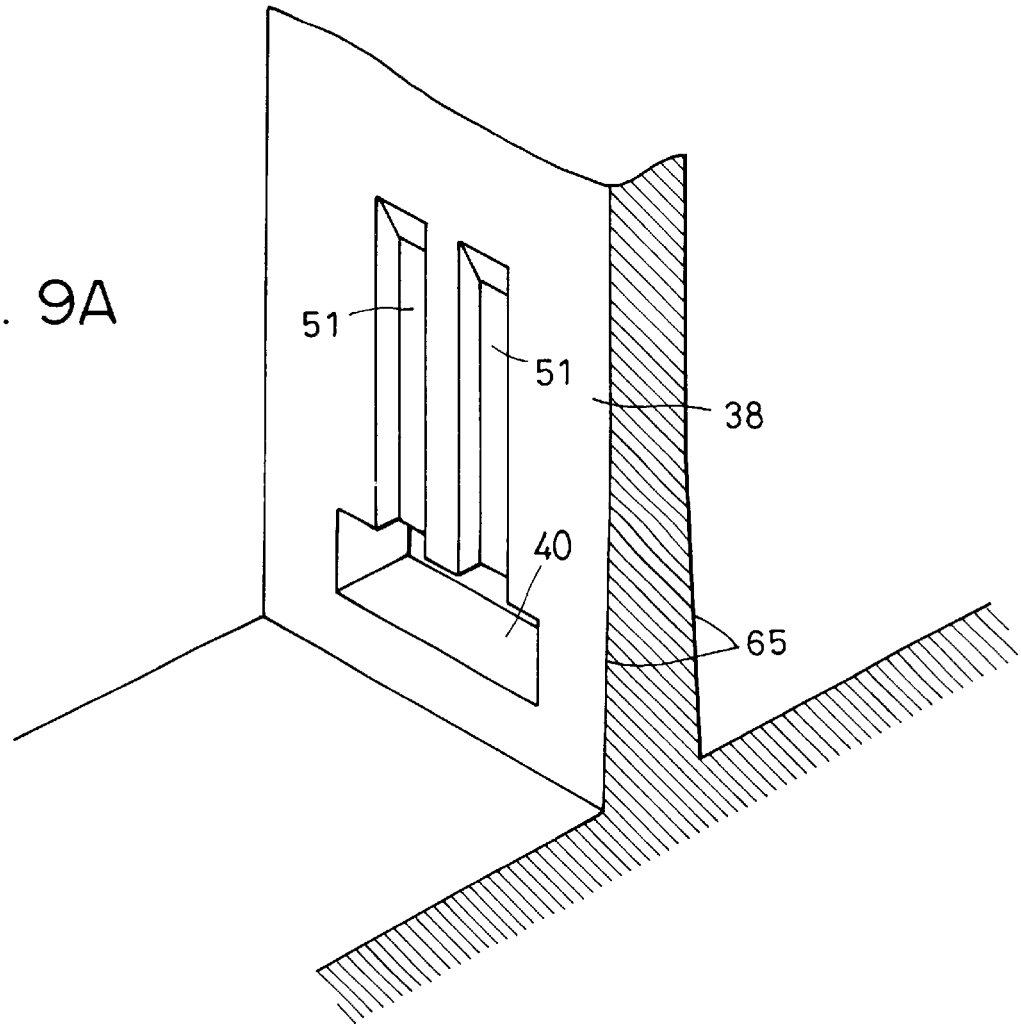
FIGS. 9A and 9B are schematic illustrations useful for describing an eighth embodiment of this invention; of these illustrations.
Figure 9B:
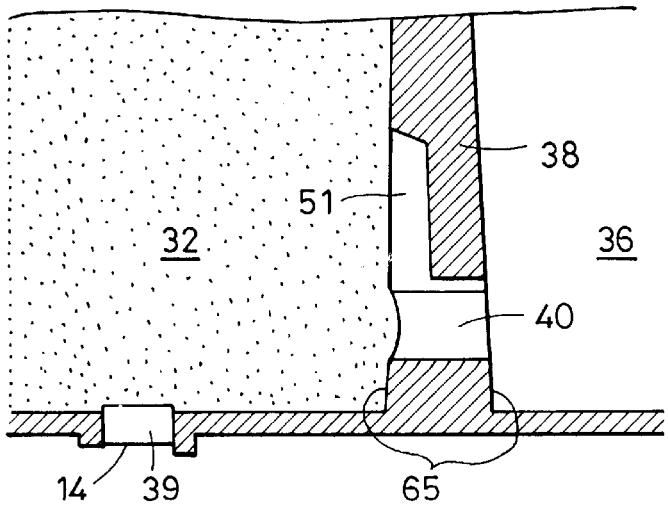
Figure 10A:
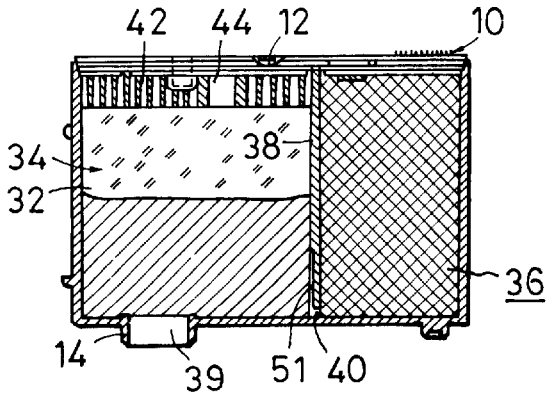
PRIOR ART FIG. 10A
FIGS. 10A to 10E are schematic illustrations for explaining an object of this invention.
Figure 10C:
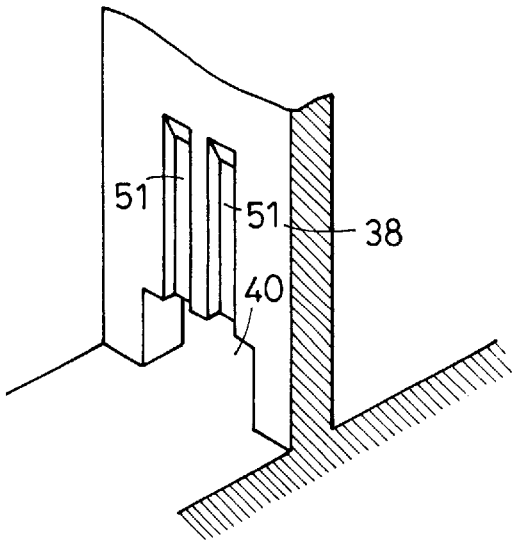
Figure 10B:
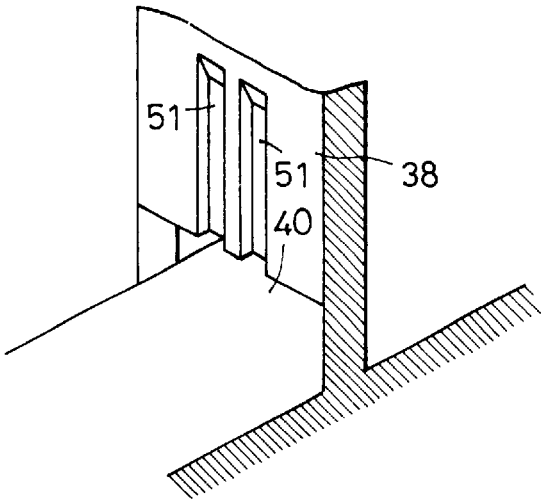
Figure 10D:
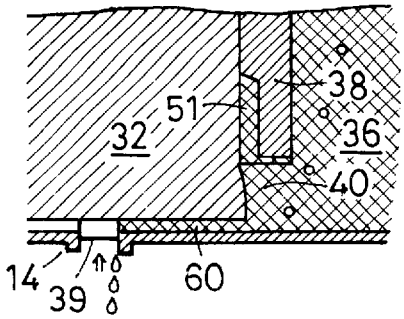
Figure 10E:
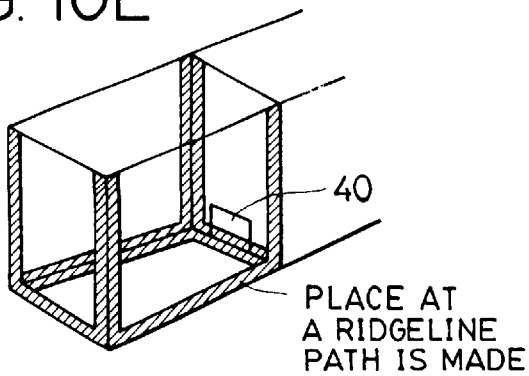

FIGS. 9A and 9B are schematic illustrations of a portion of a liquid storing container according to an eighth embodiment of this invention. FIG. 9A is a schematic perspective view while FIG. 9B is a schematic cross-sectional view.

This embodiment is similar to the above-described first embodiment except that a partition wall 38 has a tapered section 65 so that the thickness thereof increases toward the bottom of the tank. This construction can improve the close adhesion between an absorber and a tank inner wall at a lower section of the tank, particularly between the partition wall 38 and the absorber to restrain the occurrence of an air path. The other construction is similar to that of the first embodiment.

The constructions described above can be employed individually, or a combination of some of the constructions can exhibit composite effect, thus offering an ink tank with a superior construction which can cut the communication of an air path, if any, with the communicating hole without impairing the ink service efficiency.

It should be understood that the present invention is not limited to the constructions concretely described above, and that it is intended to cover all changes and modifications of the embodiments of the invention herein used for the purpose of the disclosure, which do not constitute departures from the spirit and scope of the invention.

Although the above description relates to the employment of a fiber absorber, the construction according to this invention is also applicable to the use of an urethane foam. If this invention is applied, then the reliability of a tank constructed using a urethane foam becomes higher, and easier manufacturing becomes possible.

Figure 11:
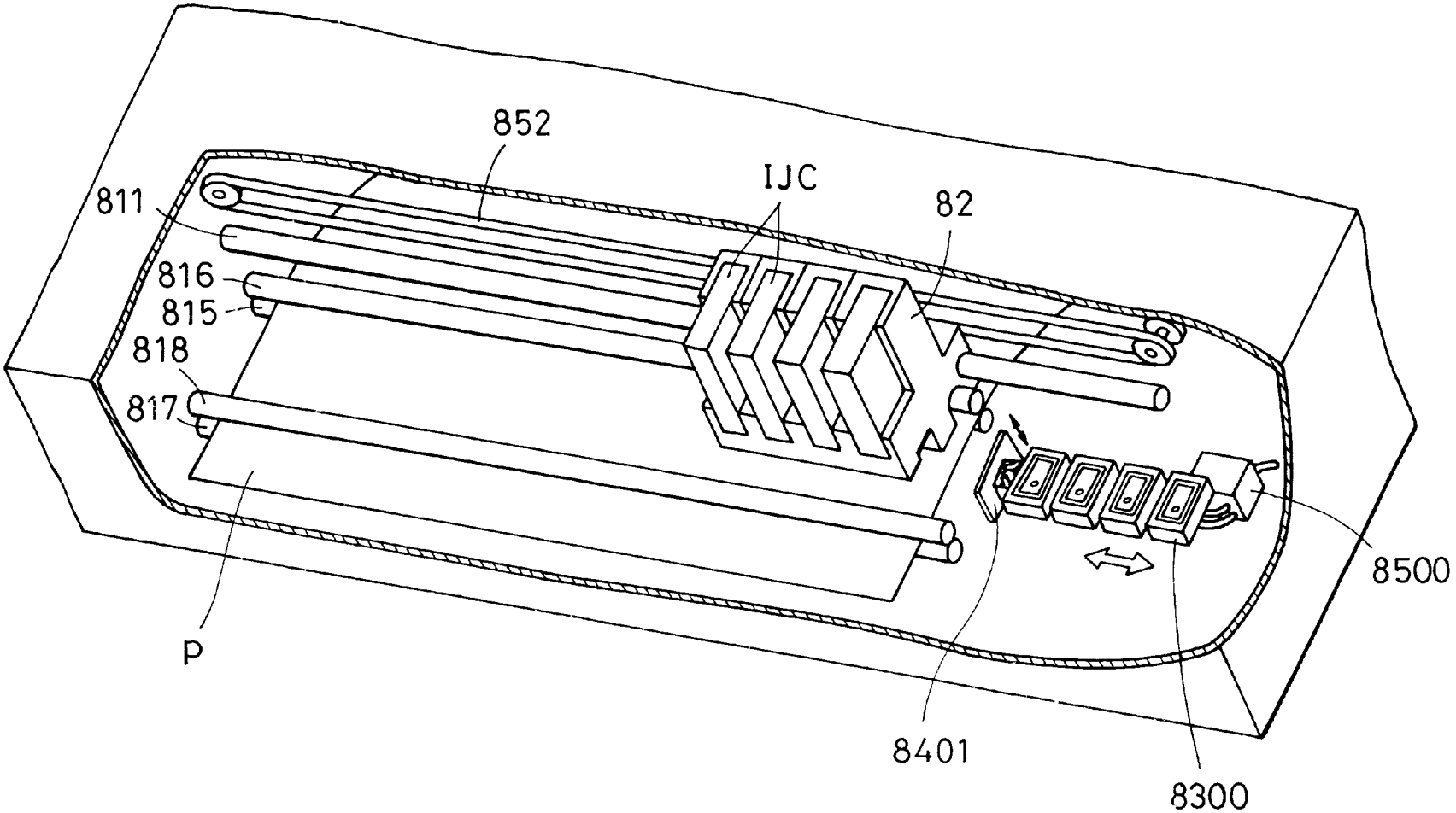
FIG. 11 is a schematic illustration of a liquid jet recording apparatus to which this invention is applicable.

FIG. 11 is a perspective view schematically showing an ink jet printing apparatus using the above-described head cartridge. This apparatus is a printer of a full-color serial type having an ink tank integrated head cartridge, attachable/detachable to/from the carriage, for handling four color inks of black (Bk), cyan (C), Magenta (M) and yellow (Y). A head section of a head cartridge to be used in this printer has 128 ejection openings and provides a definition of 400 dpi at a drive frequency of 4 KHz.

In FIG. 11, IJC represent four head cartridges for the inks Y, M, C and Bk, with the recording heads being integrated structurally with ink tanks storing inks to be supplied thereto. Each of the head cartridges IJC is mounted detachably in the carriage by a means not shown. The carriage 82 is engaged with a guide shaft 811 to be slidable therealong, and is connected to a portion of a drive belt 852 driven by a non-shown main-scanning motor. Accordingly, the head cartridge IJC becomes movable along the guide shaft 811 for the main scanning operation. Reference numerals 815, 816, 817 and 818 denote conveying rollers extending in substantial parallel with the guide shaft 811 on the rear and front sides of the illustration in the printing area depending on the scanning by the head cartridges IJC. The conveying rollers 815 to 818 are driven by a non-shown feeding motor (not shown) to convey a print medium P. A print surface of this print medium P conveyed is placed in an opposed relation to a plane including the ejection openings of the head cartridges IJC.

A recovery system unit is provided to face a movable area of the cartridge IJC adjacent to a print area of the head cartridge IJC. In the recovery system unit, numeral 8300 designates a cap unit located for the corresponding one of the plurality of cartridges IJC each having a head section. The cap unit is slidable in accordance with the movement of the carriage 82 in the right- and left-hand directions in the illustration, and further movable up and down. When the carriage 82 is at its home position, it is joined to the head section to cap the head section. Additionally, in the recovery system unit, numeral 8401 denotes a blade acting as a wiping member.

Moreover, numeral 850 depicts a pump unit for absorbing ink or the like from the ejection openings of the head sections and the vicinity thereof through the cap units 8300.

As obvious from the above description, according to this invention, it is possible to prevent an air path occurring the difference in dimension among absorbers or the pushing-up of the absorber at mounting from communicating with the liquid storage chamber, thus providing a liquid storing container which does not cause ink leakage from the ink supply openings.

In addition, it is possible to provide an ink jet head cartridge capable of achieving stable ink ejection.

Still additionally, it is possible to offer a liquid jet recording apparatus capable of accomplishing stable recording.

What is claimed is:

1. A liquid storing container attachable and detachable to and from a recording device, comprising:

a negative pressure producing member storage chamber including a bottom wall and opposed side walls and constructed to accommodate a negative pressure producing member, said negative pressure producing member storage chamber being equipped with a liquid supplying section in the bottom wall for attachment to the recording device and an atmosphere communicating section;

a liquid storage chamber having a communicating hole for establishing communication with said negative pressure producing member storage chamber and made to define a substantially hermetically sealed space for storing liquid to be supplied to said negative pressure producing member;

a partition wall between said negative pressure producing member storage chamber and said liquid storage chamber, said communicating hole being defined by said partition wall; and a path made in a vicinity of said communicating hole on the negative pressure producing member storage chamber side of said partition wall for introducing atmosphere from said negative pressure producing member storage chamber into said liquid storage chamber, wherein said negative pressure producing member is made with a fiber material having directionality and said communicating hole is offset from said bottom wall.

2. A liquid storing container according to claim 1, wherein both of a side surface of said negative pressure producing member storage chamber constituting said partition wall and defining at least an upper edge portion of said communicating hole, and a side surface of said negative pressure producing member storage chamber constituting said partition wall and defining at least a lower edge portion of said communicating hole, are both substantially organized in a common plane.

3. A liquid storing container according to claim 1, wherein said negative pressure producing member is in a contacting condition with a periphery of said communicating hole in said partition wall.

4. A liquid storing container according to claim 3, wherein said fiber material is formed from fibers having a coaxial configuration, with a central section thereof being made of polypropylene and a circumferential section thereof being made of polyethylene.

5. A liquid-storing container according to claim 1, wherein a lower edge portion of an opening constituting said communicating hole is formed as a surface inclined toward a negative pressure producing member storage chamber side.

6. A liquid storing container according to claim 1, wherein an entirety of a circumference of an opening constituting said communicating hole is formed as a surface inclined toward a negative pressure producing member storage chamber side.

7. A liquid storing container according to claim 1, wherein a step portion is formed on said bottom wall of said negative pressure producing member storage chamber in a vicinity of said partition wall to be higher toward said partition wall.

8. A liquid storing container according to claim 1, wherein a bottom surface of said liquid storage chamber and a lower edge of said communicating hole are equal in height to each other.

9. A liquid storing container according to claim 1, wherein a capillary producing groove is made at a step portion standing at a lower section of said partition wall to extend from said liquid storage chamber to said negative pressure producing member storage chamber.

10. A liquid storing container according to claim 1, wherein a lower section of said partition wall is formed as an inclined surface rising from a bottom surface of said liquid storage chamber toward said negative pressure producing member storage chamber.

11. A liquid storing container according to claim 1, wherein a rib protruding toward said negative pressure producing member storage chamber is made in a vicinity of a negative pressure producing member storage chamber side lower edge portion of an opening constituting said communicating hole and in a vicinity of a side edge portion thereof.

12. A liquid storing container according to claim 1, wherein said partition wall is made so that its thickness increases toward a bottom surface side of said liquid storage chamber.

13. An ink jet heat cartridge comprising a liquid storing container defined in claim 1 and a liquid ejection recording head section from which a liquid stored in said container is ejectable.

14. A liquid ejection recording apparatus comprising an ink jet heat cartridge defined in claim 13 and a section for mounting said ink jet head cartridge.

15. A liquid storing container attachable and detachable to and from a recording device, comprising:

a negative pressure producing member storage chamber including a bottom wall and opposed side walls and constructed to accommodate a negative pressure producing member, said negative pressure producing member storage chamber being equipped with a liquid supplying section in the wall for attachment to the recording device and an atmosphere communicating section;

a liquid storage chamber having a communicating hole for establishing communication with said negative pressure producing member storage chamber and made to define a substantially hermetically sealed space for storing liquid to be supplied to said negative pressure producing member;

a partition wall between said negative pressure producing member storage chamber and said liquid storage chamber, said communicating hole being defined by said partition wall; and a path made in a vicinity of said communicating hole on the negative pressure producing member storage chamber side of said partition wall for introducing atmosphere from said negative pressure producing member storage chamber side of said partition wall for introducing atmosphere from said negative pressure producing member storage chamber into said liquid storage chamber, wherein said negative pressure producing member is made with a fiber material having directionality and said communicating hole is offset from said bottom wall and said opposed side walls.

16. A liquid storing container attachable and detachable to and from a recording device, comprising:

a negative pressure producing member storage chamber including a bottom wall and opposed side walls and constructed to accommodate a negative pressure producing member, said negative pressure producing member storage chamber being equipped with a liquid supplying section in the wall for attachment to the recording device and an atmosphere communicating section;

a liquid storage chamber having a communicating hole for establishing communication with said negative pressure producing member storage chamber and made to define a substantially hermetically sealed space for storing liquid to be supplied to said negative pressure producing member;

a partition wall between said negative pressure producing member storage chamber and said liquid storage chamber, said communicating hole being defined by said partition wall; and a path made in a vicinity of said communicating hole on the negative pressure producing member storage chamber side of said partition wall for introducing atmosphere from said negative pressure producing member storage chamber side of said partition wall for introducing atmosphere from said negative pressure producing member storage chamber into said liquid storage chamber, wherein said negative pressure producing member is made with a fiber material having directionality and said communicating hole is offset from said bottom wall.

* * * * *